US010716370B2

(12) United States Patent
Bayley et al.

(10) Patent No.: US 10,716,370 B2
(45) Date of Patent: Jul. 21, 2020

(54) WATCH STRAP

(71) Applicant: TomTom International B.V., Amsterdam (NL)

(72) Inventors: Stephen Bayley, Amsterdam (NL); Martin Riddiford, Amsterdam (NL); Jonathan Chan, Amsterdam (NL)

(73) Assignee: TOMTOM INTERNATIONAL B.V., Amsterdam (NL)

( * ) Notice: Subject to any disclaimer, the term of this patent is extended or adjusted under 35 U.S.C. 154(b) by 0 days.

(21) Appl. No.: 15/752,064

(22) PCT Filed: Sep. 2, 2016

(86) PCT No.: PCT/EP2016/070726
§ 371 (c)(1),
(2) Date: Feb. 12, 2018

(87) PCT Pub. No.: WO2017/037238
PCT Pub. Date: Mar. 9, 2017

(65) Prior Publication Data

US 2018/0235327 A1 Aug. 23, 2018

(30) Foreign Application Priority Data

Sep. 3, 2015 (GB) ..... 1515656.5

(51) Int. Cl.
*A44C 5/00* (2006.01)
*A44C 5/20* (2006.01)
*A44C 5/14* (2006.01)

(52) U.S. Cl.
CPC ..... *A44C 5/2071* (2013.01); *A44C 5/0053* (2013.01); *A44C 5/14* (2013.01); *A44C 5/2085* (2013.01)

(58) Field of Classification Search
CPC ..... A44C 5/2071; A44C 5/0053; A44C 5/14; A44C 5/2085
(Continued)

(56) References Cited

U.S. PATENT DOCUMENTS 1,851,733 A 3/1932 Shapiro
2,466,741 A 4/1949 Roehrl
(Continued)

FOREIGN PATENT DOCUMENTS

CN 2754416 Y 2/2006
CN 2882245 Y 3/2007
(Continued)

OTHER PUBLICATIONS

Search report of United Kingdom application 1515656.5 dated Mar. 4, 2016.
(Continued)

*Primary Examiner* — Peter N Helvey

(57) ABSTRACT

A strap (2) for a watch (1) comprising: a first fastening portion (4); a watch supporting portion (6); and a second fastening portion (8). The first and second fastening portions comprise a series of holes (22, 24) spaced along each fastening portion. The first fastening portion further comprises an opening (10) through which the second fastening portion can be threaded and at least one pin (12) projecting inwards from the strap so as to be received in a hole in the second fastening portion. The second fastening portion further comprises at least one pin (14) projecting inwards from the strap so as to be received in a hole in the first fastening portion when the second fastening portion is threaded through the opening and laid on top of the first fastening portion. The first fastening portion further com-
(Continued)

prises at least one peg (18) projecting outwards from the strap so as to engage in a hole in the second fastening portion.

16 Claims, 5 Drawing Sheets

(58) Field of Classification Search
USPC ..... 224/164
See application file for complete search history.

(56) References Cited

U.S. PATENT DOCUMENTS

| | | | |
|---|---|---|---|
| 2,466,742 | A | 4/1949 | Roehrl |
| 2007/0034165 | A1 | 2/2007 | Yang |
| 2014/0083133 | A1 | 3/2014 | Lee |
| 2015/0102075 | A1 | 4/2015 | Junya |

FOREIGN PATENT DOCUMENTS

| | | | |
|---|---|---|---|
| CN | 203789919 | U | 8/2014 |
| CN | 203952645 | | 11/2014 |
| EP | 2859840 | | 4/2015 |
| JP | 2009225834 | | 10/2009 |
| WO | 0065531 | | 11/2000 |

OTHER PUBLICATIONS

International Search Report of PCT application PCT/EP2016/070726 dated Nov. 18, 2016.

WATCH STRAP

CROSS-REFERENCE TO RELATED APPLICATIONS

The present application is a National Stage of International Application no. PCT/EP2016/070726, filed on Sep. 2, 2016, and designating the United States, which claims benefit to United Kingdom Patent Application 1515656.5 filed on Sep. 3, 2015. The entire content of these applications is incorporated herein by reference.

FIELD OF THE INVENTION

This invention relates to watches, and more specifically to the strap of such watches. Illustrative embodiments of the invention relate to a strap for supporting devices for monitoring athletic performance, e.g. those which can be worn by runners, cyclists etc., which can track and record the pace of the user at particular moments during a workout and/or the distance covered by the user during the workout. Such devices are commonly referred to as fitness watches or activity trackers.

BACKGROUND OF THE INVENTION

In recent years the use of fitness watches by athletes has significantly increased. Such fitness watches typically incorporate various features, for example GPS, and are often used by joggers, runners, cyclists and other athletes and outdoor enthusiasts as a means to obtain real-time data of their speed, distance travelled etc. As mentioned, fitness watches are typically used in situations where the user is highly active which often results in their arms undergoing significant movement. In situations where a user's arms experience significant movement it is known that the watch strap may become loose or undone which can increase the risk of the watch falling away from the user's wrist. Additionally, as the watch loosens, it can cause the watch to move around on the user's wrist which can become annoying, particularly during physical activity. If the watch includes an optical heart rate sensor then movement of the watch is likely to affect the accuracy of heart rate measurements.

It is desired, in at least embodiments of the present invention, to provide an improved strap for a watch, preferably a fitness watch.

SUMMARY OF THE INVENTION

When viewed from a first aspect the present invention provides a strap for a watch, optionally a fitness watch, comprising a first fastening portion, a watch supporting portion, and a second fastening portion, the first and second fastening portions comprising a series of holes spaced along each fastening portion, the first fastening portion comprising an opening through which the second fastening portion can be threaded and at least one pin projecting inwards from the strap so as to be received in a hole in the second fastening portion, and the second fastening portion comprising at least one pin projecting inwards from the strap so as to be received in a hole in the first fastening portion when the second fastening portion is threaded through the opening and laid on top of the first fastening portion, wherein the first fastening portion further comprises at least one peg projecting outwards from the strap so as to engage in a hole in the second fastening portion.

The at least one peg provided on the first fastening portion provides additional localised tension between the fastening portions, this helps to keep the pins engaged in the holes on the corresponding fastening portions. Ensuring a strong engagement of the pins helps to reduce the risk of the strap becoming loose or undone. The further engagement between the at least one peg and the second fastening portion provides an additional point of engagement to hold the fastening portions in place and thus further reduces the risk of the strap inadvertently coming loose or undone. Even in the unlikely event that both pins and the peg become disengaged, the strap is less likely to fall from the user's wrist as the at least one peg typically snags on the second fastening portion as it slides through the opening. This helps to prevent the strap from undesirably falling from the user's wrist.

A further benefit of the at least one peg is that the localised tension acts to hold the second fastening portion tighter against the first fastening portion adjacent the opening. This improves the aesthetics of the strap.

The at least one peg projecting outwards from the strap and engaging in a hole in the second fastening portion is particularly advantageous as the second fastening portion is now secured from both sides. This is particularly useful in the field of fitness watches where the watch strap is subject to a range of forces on the user's wrist which could cause the strap to become undone.

It is preferable that a user can easily slide the second fastening portion through the opening in the first fastening portion. In a set of embodiments the at least one peg projects from an angled portion of the first fastening portion that forms an edge of the opening. The angled portion assists in guiding the second fastening portion when threading it through the opening. In addition, or alternatively, the at least one peg is angled relative to an outwards facing surface of the first fastening portion, preferably towards the direction in which the second fastening portion is threaded through the opening. It is appreciated that angling the at least one peg in such a direction makes it easier for the second fastening portion to be threaded through the opening. Additionally angling the at least one peg in this direction causes it to engage with the second fastening portion in such a way so as to resist the second fastening portion from becoming undone. The angle is preferably an acute angle. It is appreciated that the angle of the at least one peg is chosen such that the strap can still be manually undone by the user. It may, for example, require the user to initially pull the second fastening portion in a direction to slightly further tighten the strap before it is possible to disengage the at least one peg and then loosen the strap.

The use of the at least one pin on each of the first and second fastening portions, to engage with the corresponding fastening portion, is particularly advantageous as the strap can be provided without a conventional buckle. The strap no longer requires a hinged pin to engage with holes in the corresponding fastening portion as with typical straps. The pins may, for example, be integrally moulded with the fastening portions. This may allow the strap to be manufactured from a single piece of material. For example, the strap could be injection moulded from a single piece of plastic. Manufacturing the watch strap in this manner may allow for mass production and furthermore may remove the need for assembly both aspects of which are likely to reduce the manufacturing costs.

In a set of embodiments at least one of the pins is fixed relative to the respective first or second fastening portion. In a preferred set of embodiments all of the at least one pins are fixed relative to the fastening portions. The presence of such fixed pins eliminates the need for a hinged pin and buckle, again reducing the number of components of the watch strap.

In a set of embodiments the opening is integrally moulded with the first fastening portion. This removes the need for a typical hinged buckle as used on conventional watch straps. As described above, by integrally moulding the opening, the strap no longer requires a buckle to be separately attached to the strap and thus reducing manufacturing costs and complexity. The elimination of any moving parts also increases the simplicity of the strap which makes it more hygienic and/or easier to clean.

In a set of embodiments the at least one pin of the second fastening portion is located on the distal end of the second fastening portion proximal to the end which first passes through the opening in the first fastening portion. Positioning the at least one pin at this end is advantageous as, when the strap is fastened, it ensures the entire length of the second fastening portion held against the strap. This prevents the second fastening portion from being loose when worn and thus avoiding annoyance to the user which may result from a strap which can move substantially during use. In a further set of embodiments the at least one pin of the first fastening portion is located at the distal end of the first fastening portion. In a further preferred set of embodiments the at least one pin is positioned proximal to the opening which is preferably positioned proximal to the distal end of the first fastening portion. The at least one pin being located proximal to the opening is beneficial as when the strap is threaded it ensures that the first fastening portion is securely fastened to the second fastening portion and thus prevents excessive movement during use.

In a set of embodiments the at least one pin and the at least one peg of the first fastening portion are positioned on opposite sides of the opening. This configuration is advantageous as when the second fastening portion is threaded through the opening, at least part of the second fastening portion is secured from both sides. Additionally the proximity of the at least one pin and at least one peg to each other, reduces the ability of the second fastening portion to become loose without manual intervention from the user. For example, if the at least one pin and the at least one peg were spaced significantly apart it is expected that it may be easier for the second fastening portion to become disengaged from the at least one pin and/or the at least one peg.

In a set of embodiments the at least one pin of the first fastening portion and of the second fastening portion are normal to their respective fastening portions. This allows the pins to be easily received in the holes on the corresponding fastening portion and ensures that the pins are securely engaged.

In a set of embodiments the at least one pin of the second fastening portion and preferably the at least one pin of the first fastening portion has a flanged portion at its end. In a preferred set of embodiments the flanged portion has a diameter which is larger than the diameter of the holes in the fastening portions, for example slightly larger. The difference in diameter may, for example, be about 0.5 mm. In a further preferred set of embodiments the fastening portions are made from a resilient material such that the flanged portions of the pins can be pushed through, and pulled out of, the holes when a sufficient force is applied. It is desirable that the force is sufficient that the pins cannot come out of the holes without physical intervention by the user. It is appreciated that this arrangement of the flanged portions allows for a more secure engagement of the pins. In a further preferred set of embodiments the holes in the first and second fastening portions are provided with recessed portions on an inwards facing side of the strap which is worn against a user's wrist. These recessed portions accept the flanged portions of the pins and thus prevent the flanged portions from protruding from the inside of the strap. This is advantageous as it reduces the potential risk of irritation to the user.

In one set of embodiments a pair of pins is provided on both the first and second fastening portions and a pair of pegs is provided on the first fastening portion. In such an embodiment two rows of holes are provided on both the first and second fastening portions. The presence of the pairs of pins and the pair of pegs increases the physical engagement between the fastening portions thus reducing the chance that the strap becomes undone.

It is preferable that the strap forms around the wrist of a wearer and can be easily fastened. Therefore, in a set of embodiments, the first and second fastening portions are more flexible than the watch supporting portion. This allows the strap to easily form around the user's wrist and also makes threading the second fastening portion through the opening easier. It is appreciated that this could be achieved by various means, for example by manufacturing the fastening portions from a different material to the watch supporting portion or alternatively by having different thicknesses of material for each portion. Additionally, by making the watch supporting portion stiffer than the fastening portions, it reduces the ability for the watch to slip around the user's wrist during use.

The watch supporting portion may be split between the first and second fastening portions. For example the first and second fastening portions may each comprise an end connector that supports a watch therebetween. The first and second fastening portions may, for example, comprise an engagement mechanism which is able to support a watch. However, in a preferred set of embodiments, the strap comprises an integral watch supporting portion provided between the first and second fastening portions. In a further preferred set of embodiments the watch supporting portion has a moulded shape.

The watch supporting portion may have a watch module attached in use. It is preferable that the watch module can be easily removed and replaced, this for example could be to allow the watch module to be docked to transfer data or recharge. In a preferred set of embodiments the watch supporting portion comprises at least one aperture for receiving a watch module. Such an embodiment is particularly advantageous as it may allow the watch module to be repeatedly engaged and disengaged with the strap. In a further preferred set of embodiments the aperture comprises a snap-fit mechanism to secure the watch module when it is positioned within the aperture. It is appreciated that in some embodiments the aperture may be arranged such that the watch module is inserted from an inwards facing side of the strap which the user wears next to their wrist. The presence of the secure fastening system of the strap according to the present invention is particularly important in such embodiments. When the watch module is inserted from the underside, if the watch strap comes undone the watch module could become separated from the strap and potentially lost. Through use of the strap with the additional peg(s) the chance of the strap becoming undone is significantly reduced and thus the risk of the losing the watch module is reduced.

In a further preferred set of embodiments the watch supporting portion comprises two apertures i.e. one to receive the display and one to receive the user interface of a watch module. Additionally it is preferable the apertures are spaced apart in a longitudinal direction of the strap. In a further preferred set of embodiments one of the apertures has a smaller area than the other aperture. In a set of embodiments where the watch supporting portion is provided with two apertures with different sizes it is preferred that the aperture with the smaller area is positioned on a curved portion of the strap. In a further preferred set of embodiments the larger aperture is positioned on a planar portion of the strap.

According to another aspect of the invention there is provided a watch, preferably a fitness watch, comprising a watch module removably mounted to a strap according to any of the embodiments of the present invention. Preferably the strap is a wrist strap described above. Whilst it is appreciated that the watch supporting portion may support a variety of watches it may support a watch configured as a module housed by a single integral casing, and which is preferably a sealed module being water resistant to allow the device to be used for wet weather outdoor exercise and for swimming. In this configuration, the watch module can be removably mounted, i.e. repeatedly engaged and disengaged, to a plurality of different docking solutions, including the strap according to the present invention. When the watch module is not mounted by the strap, it can also be placed in a dock that is desired to be kept in the user's home, e.g. for allowing the transfer of power and/or data to the electrical components.

In a preferred set of embodiments the module may comprise a display housing that houses a display for displaying information to a user, and an input means for controlling the device, wherein the input means is spaced apart from the display housing. Accordingly the input means is preferably spaced apart from the display housing in a longitudinal direction of the strap. When the module is mounted to the strap in use the display is preferably positioned on top, i.e. facing away from the limb, for ease of viewing. The display may be configured to display alphanumeric characters or icons such that upper parts of the characters or icons are arranged towards a first side of the display housing and the lower parts of the characters or icons are arranged towards a second, opposite side of the display housing. The input means is preferably spaced apart from the display housing in a direction from said first side to said second side. This configuration is useful when the user wears the display housing on the back of the wrist, as the user is easily able to view the display whilst controlling the device via the input means that is spaced apart from the display. Less preferably, the input means may be spaced apart from the display housing in a direction from said second side to said first side of the display housing. This configuration may be useful, for example, when the device is strapped to the handle bars of a bicycle or strapped to another vehicle, as the display can be directed towards the user whilst the user has easy access to the input means from above the device.

The input means of the user interface is configured to control the module in use. For example, the input means may control the functioning of the watch and may be used to navigate through a menu displayed on the device. The input means is therefore electrically connected to electronic components in the display housing. For example, a ribbon lead may extend between the display housing and the input means.

The input means preferably has a substantially planar surface arranged substantially parallel to and above an upper surface of the device. The input means is preferably configured to detect the movement of a user's finger across the substantially planar surface so as to provide an input to control the device, e.g. for navigating a menu displayed on the display of the device.

The input means may therefore comprise a touchpad (or trackpad) utilising, for example, capacitive sensing to conductance sensing to translate the motion of a user's finger into an input to control the device. The touchpad may comprise a one-dimensional touchpad, and which is capable of sensing motion along a single axis, e.g. left-right or up-down. In other more preferred embodiments, the touchpad may comprise a two-dimensional touchpad, and which is capable of sensing motion in any direction, or at least left-right and up-down, on the plane defined by the substantially planar surface of the input means. In other, albeit less preferred embodiments, the input means may comprise a pointing stick (or trackpad) that senses the force applied by a user's finger, e.g. by using a pair of resistive strain gauges, and translates it into an input to control the device.

Alternatively, the input means may comprise a two-way button having a continuous pressing surface and two actuators, the button being configured such that when a first portion of the pressing surface is depressed a first of said actuators is actuated so as to provide a first input to control the device, and when a second portion of the pressing surface is depressed a second of said actuators is actuated so as to provide a second input to control the device.

Alternatively, the input means may comprise a four-way button having a continuous pressing surface and four actuators, the button being configured such that when a first portion of the pressing surface is depressed a first of said actuators is actuated so as to provide a first input to control the device, when a second portion of the pressing surface is depressed a second of said actuators is actuated so as to provide a second input to control the device, when a third portion of the pressing surface is depressed a third of said actuators is actuated so as to provide a third input to control the device, and when a fourth portion of the pressing surface is depressed a fourth of said actuators is actuated so as to provide a fourth input to control the device. The pressing surface described herein is preferably a substantially planar surface parallel to and above a portion of a lower surface that contacts a user's limb in use. It is also contemplated that the input means may comprise any one or more mechanically actuated buttons or non-mechanically actuated buttons, such as virtual buttons on a touch-sensitive user interface, as desired.

The input means is preferably additionally, or alternatively, configured to be operated by being pressed in a direction that is substantially perpendicular to its substantially planar surface, in a direction from the upper surface towards the lower surface. This enables the user to use a single finger to operate the input means. The user does not need to use a second finger of the same hand to counterbalance the pressing of the input means, because the input means is arranged such that it is pressed against the wrist of the user wearing the strap.

In preferred embodiments in which the input means is configured to both detect the movement of a user's finger across the substantially planar surface and be pressed against the limb of the user, e.g. where in the input means comprises a depressible touch pad, the detected motion of the user's finger is used to navigate a menu for identifying a function to be selected, and the depression of the input means is used to select the identified function.

As discussed above, the input means preferably has a substantially planar surface arranged substantially parallel to and above a portion of the upper surface, and which in some embodiments comprises a pressing surface for controlling the device when pressed. In embodiments, the input means defines a chamber, e.g. beneath the planar (or pressing) surface, which (as discussed in more detail below) can be used to house one or more components of the device, rather than in the display housing.

In addition, or alternatively, the display housing preferably has a substantially planar display, such as an LCD display, arranged in a first plane and the input means preferably has a substantially planar (pressing) surface arranged in a second plane, wherein the first and second planes are at angles to each other. The dihedral (or torsion) angle between the two planes is preferably less the 90 degrees, and preferably between 20 and 70 degrees. In other words, the planes are imaginary intersecting planes and the sides of the planes facing the user's arm or wrist in use define an angle between them at the intersection, wherein the angle is preferably greater than 90 degrees and less than 180 degree. By providing the surfaces at an angle to each other, the user is enabled a good viewing angle of the display whilst operating the input means, when the device is mounted to a user's arm in use. As the input means is spaced away from the display housing, and hence away from the back of the user's wrist and around the side of the wrist in use, said angle also enables the input means to be orientated such that when it is pressed it is pressed against the user's wrist such that the user's wrist provides the counter-force necessary to balance the pressing force. The input means is therefore able to be operated with a single finger and without needing a second finger on the same hand to counter-balance the pressing force as in conventional devices having buttons around the periphery of the display housing.

In addition, or alternatively, the display housing is preferably physically connected to the input means by a connecting portion, wherein the connecting portion is curved or angled along the direction from the display housing to the input means. The connecting portion may be curved or angled such that when the display housing is arranged on the back of a user's wrist in use, the connecting portion curves or otherwise extends around the wrist such that the input means is located on the side of the user's wrist. The watch module is preferably configured such that the input means is located on the medial side of the user's wrist when the display housing is located on the back of the wrist, the medial side being the side facing the user's body when the back of the hand is facing vertically upwards. In other less preferred embodiments the strap may form said connecting portion that connects the display housing portion and the input means. The strap may be flexible or formed from one or more pivotable sections so as to flex or pivot to form the curved or angled portion.

The display housing and the input means are preferably arranged in a single integral casing having a display housing portion and an input means portion separated by the connecting portion. The connecting portion is therefore preferably also part of the integral casing. In various embodiments the strap may comprise at least two apertures, and the display and input means may each project through a respective aperture in the strap.

In a preferred set of embodiments the module may comprise an optical heart rate (OHR) sensor. The display may comprise a display screen, such as an LCD display. The display screen may visually display heart rate (HR) data such as one or more of: current HR (bpm), average HR (bpm), maximum HR, minimum HR; current HR zone; a graphical representation of HR changes over time; and a graphical representation of the proportion of time spent in each of a plurality of HR zones over time. In addition, or alternatively, the watch module may comprise an audio output, e.g. a beeper, and/or a haptic output, e.g. a vibrator, to alert a user to changes in the HR data. In such embodiments the strap is particularly important as it ensures that the watch module is held securely against the user's wrist helping to ensure the accuracy of the HR data.

Although the present invention has been described with reference to a fitness watch strap i.e. a strap capable of supporting a fitness watch for monitoring athletic performance, it will be appreciated that the watch strap may be used to support a range of other watches.

The present invention in accordance with any of its further aspects or embodiments may include any of the features described in reference to other aspects of embodiments of the invention to the extent it is not mutually inconsistent herewith.

Advantages of these embodiments are set out hereafter, and further details and features of each of these embodiments are defined in the accompanying dependent claims and elsewhere in the following detailed description.

BRIEF DESCRIPTION OF THE DRAWINGS

Various aspects of the teachings of the present invention, and arrangements embodying those teachings, will hereafter be described by way of illustrative example with reference to the accompanying drawings, in which.

Like reference numerals are used for the like features throughout the drawings.

DETAILED DESCRIPTION OF THE PREFERRED EMBODIMENTS

Preferred embodiments of the present invention will now be described with particular reference to a strap for supporting a fitness watch. Fitness or sports watches of the type described are often worn by athletes to help them during their runs or workouts, e.g. by monitoring the speed and distance of the user and providing this information to the user.

Figure 1:
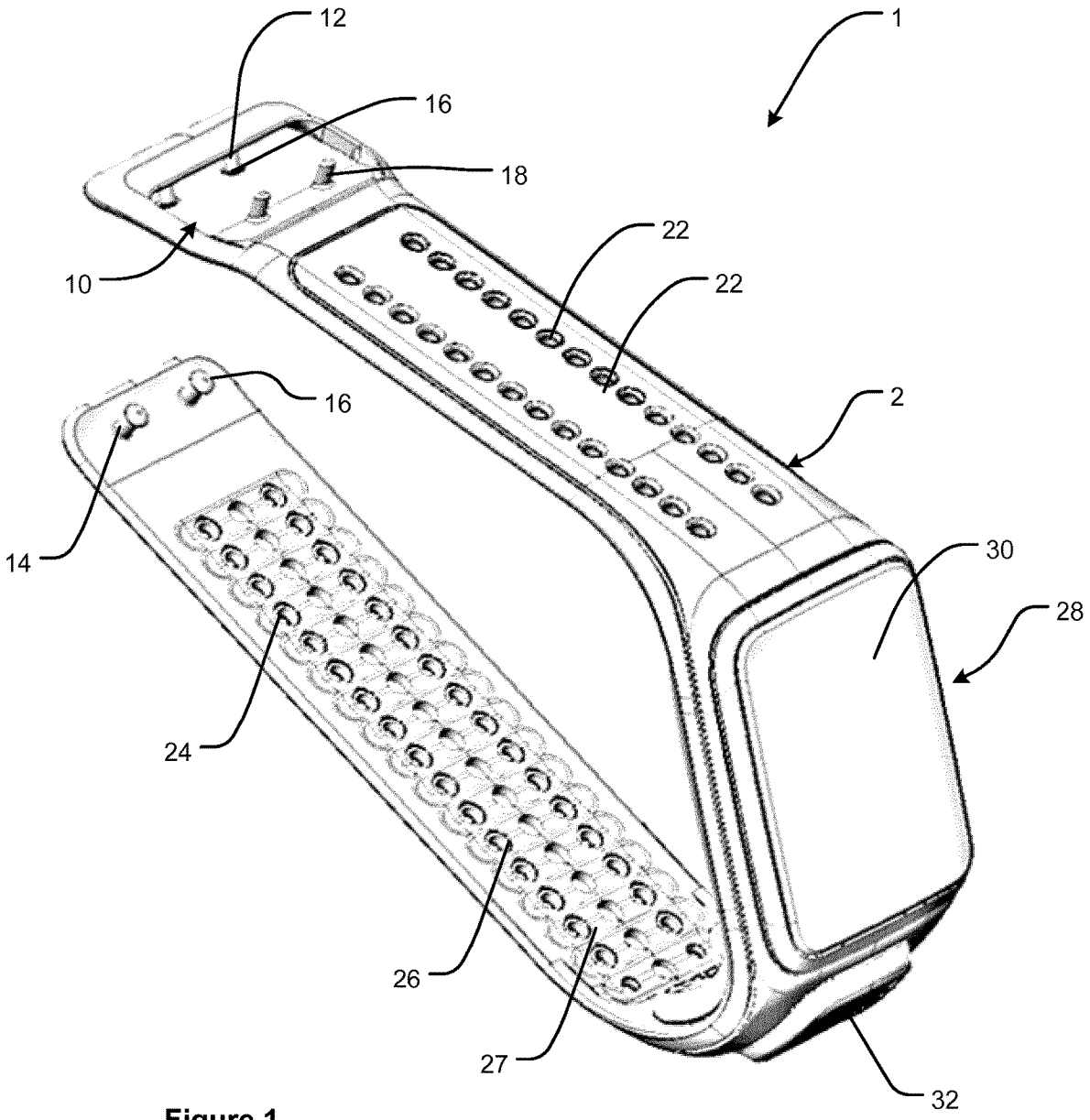
FIG. 1 shows a perspective view of a first watch strap according to a preferred embodiment.

FIG. 1 shows a perspective view of a fitness watch 1 comprising the watch strap 2 according to the present invention. The strap 2 comprises a first fastening portion 4, a watch supporting portion 6 and a second fastening portion 8. The first fastening portion 4 comprises an opening 10 at its distal end. A set of pins 12 is provided on the internal facing region of the opening 10 and a set of pins 14 is provided on the second fastening portion 8. Both sets of pins 12, 14 are provided with a flanged portion 16. A set of pegs 18 is provided on the angled portion 20 of the opening 10. A set of holes 22, 24 are provided on both the first fastening portion 4 and second fastening portion 8 respectively. The holes 22, 24 are provided with recessed portions 26. Although not shown the holes 22 on the first fastening portion 4 also have similar recessed portions. A watch module 28 is supported by the watch supporting portion 6. The watch module 28 comprises a display 30 and an input means 32. The first and second fastening portions 4, 8 are made from a flexible material.

The fitness watch 1 as seen in FIG. 1 can be fastened around a user's wrist. When positioned around a user's wrist the fastening portions 4, 8 are firstly placed around a user's wrist so that the watch supporting portion 6 rests against the top of the user's wrist such that the input means 32 is positioned on the medial side of the user's wrist. The second fastening portion 8 can then be threaded through the opening 10 vertically so that the pins 12, 14 and pegs 18 do not come into contact with the holes 22, 24. The user is then able to flex the second fastening portion 8 towards the first fastening portion 4. As second fastening portion is flexed downwards the pegs 18 engage with the holes 24 in the second fastening portion 8. The pegs 18 therefore snag the second fastening portion 8 to assist in wrapping the strap 2 around the wrist and engaging the pins 12, 14. This makes it easier for a user to put on the watch strap 2. The user must then apply a pressure to the second fastening portion 8, proximal to the pins 14, so that the pins 14 engage in the holes 22. The user can then apply pressure to the opening 10 proximal to the pins 12 so that the pins 12 engage in the holes 24. When applying pressure to the fastening portions the user must apply sufficient pressure to force the flanged portion 16 of the pins 12, 14 through the holes 24, 22 respectively. It is appreciated that the order in which the user applies pressure and thus engages the pins 12, 14 may vary depending on user preference.

Whilst the primary purpose of the holes 22, 24 in the fastening portions 4, 8 is for the pins 12, 14 to engage with they have a secondary benefit. The holes 22, 24 allow some air to circulate around the fastening portions 4, 8 to the user's wrist. This is also facilitated by the recessed portion 27 around the holes 22, 24. Air is able to pass into the holes 22, 24, which are not blocked by pins 12, 14, and fill the recessed portion 27. This helps to cool the user's wrist. This is particularly relevant for fitness watch straps which are typically made from a plastic material which is not breathable. Due to the use in physically active situations the presence of these holes 22, 24 and recessed portions 27 helps to prevent the user's wrist from sweating which may otherwise make wearing a watch uncomfortable.

Figure 2:
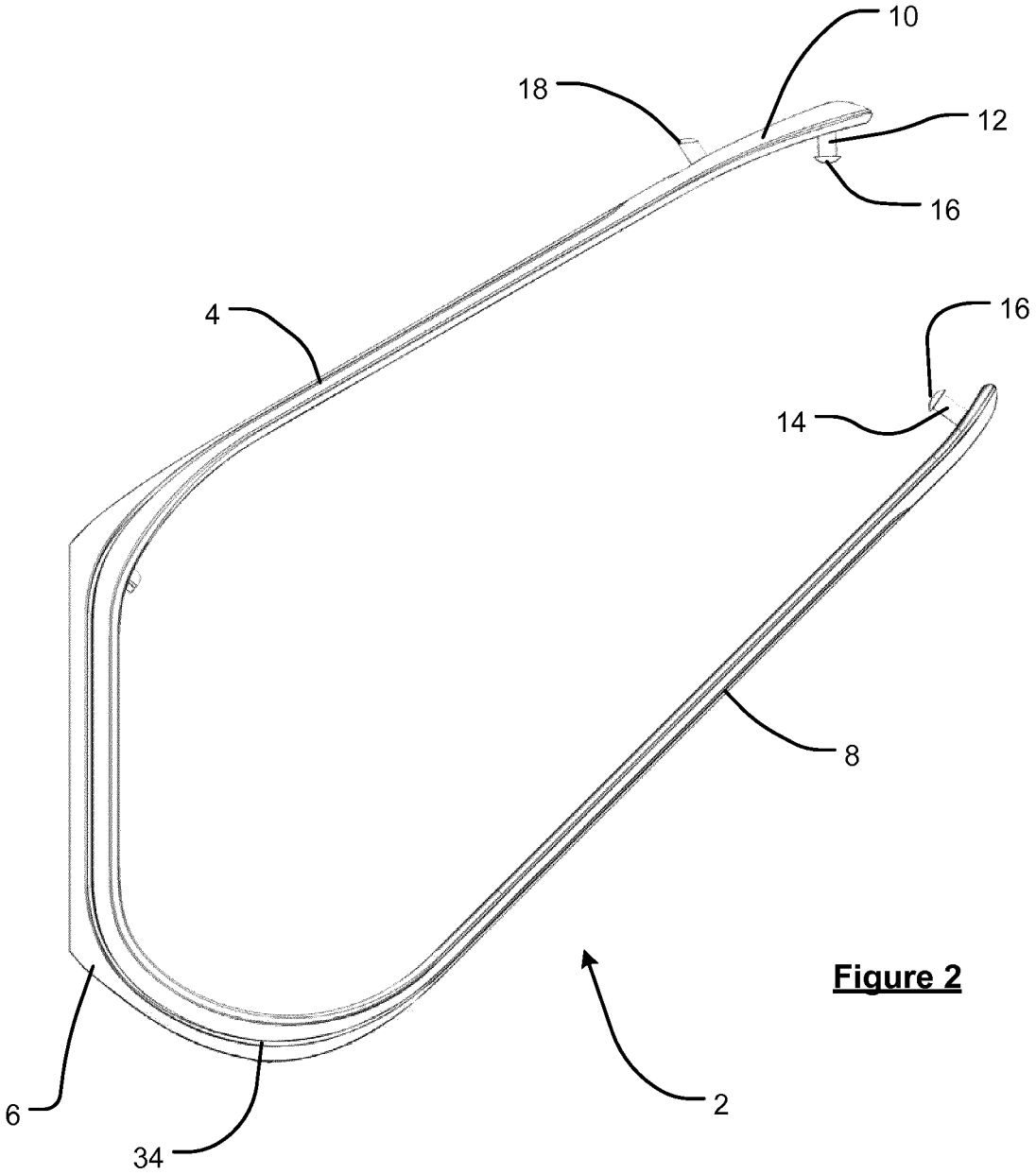
FIG. 2 shows a side view of the watch strap according to FIG. 1

FIG. 2 shows a side-view of the strap 2. This Figure shows the positioning of the pins 12, 14 and the pegs 18. It can also be seen that the flanged portions 16 are rounded which prevents the pins 12, 14 from irritating the user when the strap 2 is attached to their wrist. FIG. 2 also shows how the thickness of the strap 2 varies. It can be seen that the thickness of the watch supporting portion 6 is noticeably thicker than the fastening portions 4, 8. This provides the necessary rigidity of the watch supporting portion 6 in order for it to support the watch module 28. It can also be seen that the thicker portion of the watch supporting portion 6 extends round to a secondary portion 34, this secondary portion 34 is for supporting the user interface 32 of the watch module 28.

Figure 3:
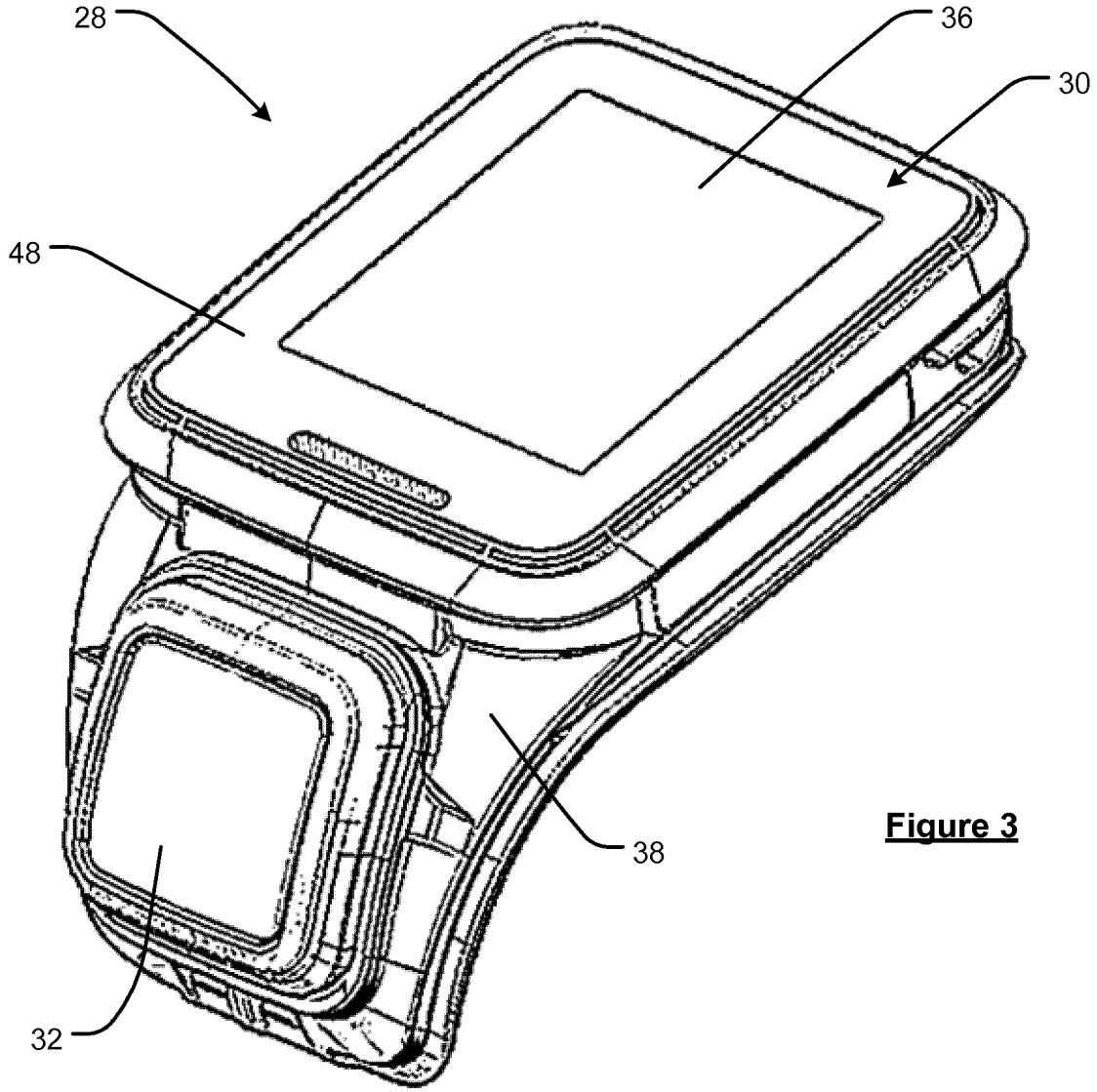
FIG. 3 shows a perspective view of a watch module.

FIG. 3 shows a perspective view of the watch module 28 when it has been disengaged from the strap 2. The watch module 28 has a display housing 30 and a user interface 32 that is spaced apart from the display housing 30. The display housing 30 is of substantially parallelepiped construction and has a substantially planar display 36 for displaying information to the user. This portion of the watch module 28 sits on the back of the user's wrist during typical use. The user interface 32 is connected to the display housing 30 by a flange 38 that extends away from the display housing 30. The flange 38 curves as it extends away from the display housing 30 such that it curves around the user's wrist in use. The user interface 32 is located on the flange 38 such that the user interface 32 is arranged on the side of the user's wrist in use. The user interface 32 has a substantially planar pressing surface for the user to interact with the watch 28. The user can thereby press the pressing surface in a direction perpendicular to the pressing surface so as to control the watch module 28, e.g. to select desired functions within the menu system of the watch.

The location of the user interface 32 being arranged on the curved flange 38 such that it sits against the side of the user's wrist in use has a number of important advantages. For example, this enables the user to interact with the watch module 28 using only a single finger. More specifically, the user is able to push the pressing surface of the user interface 32 with one finger because the user pushes the surface into the user's wrist around which the watch 28 is strapped. This is in contrast to conventional watches wherein buttons are arranged around the peripheral edges of the watch and the user must press the button with on finger and use a thumb on the other edge of the watch to counter-balance the pressing force.

The underside of the flange 38 that extends from the display housing 30 has electrical connectors (not shown) arranged at a distal end thereof. These electrical connectors may be used in order to electrically connect the casing 28 to another device in order to recharge a battery within the watch module 28 or to extract data from or input data to the watch module 28.

Figure 4:
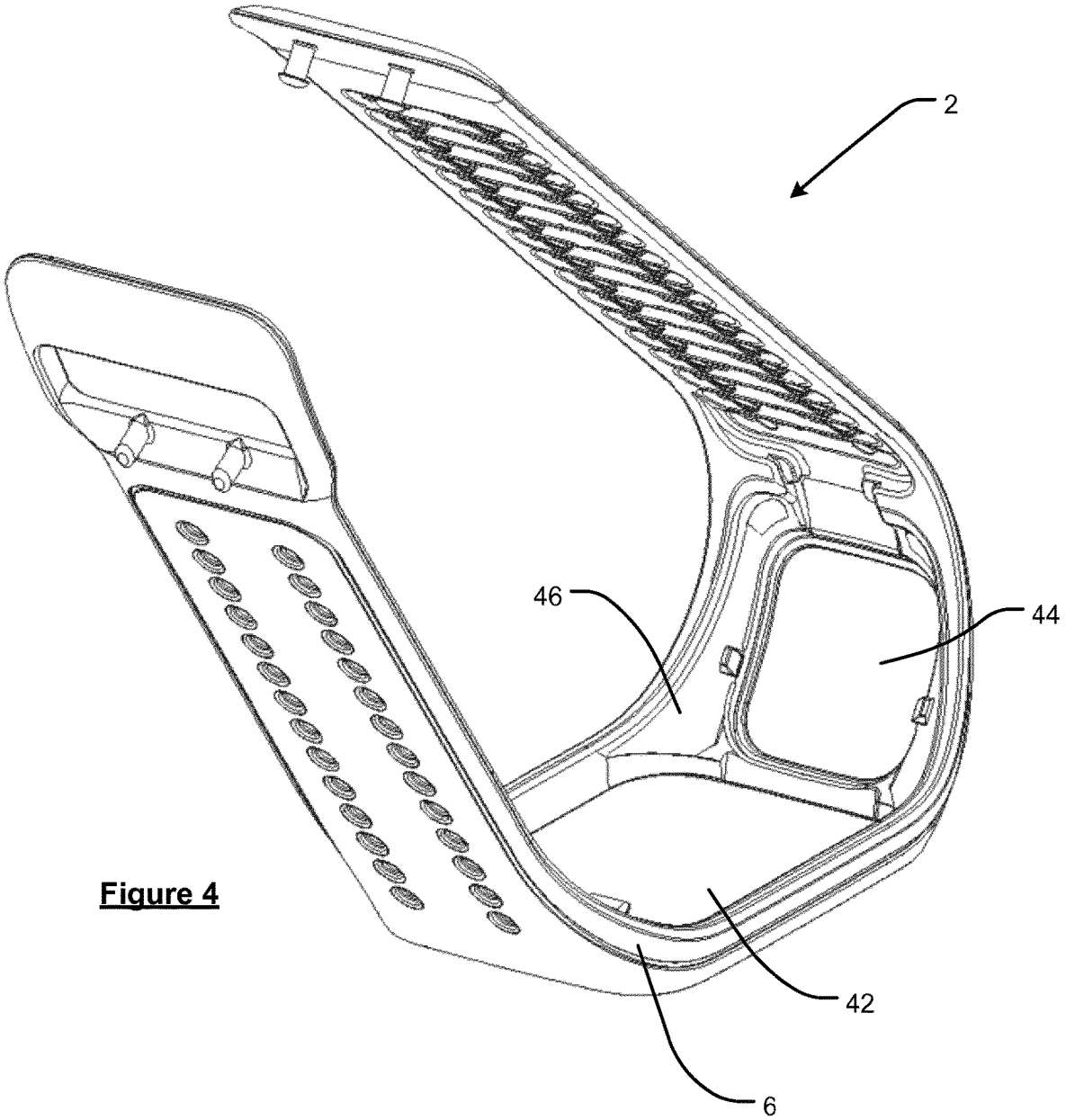
FIG. 4 shows an alternative perspective view of the watch strap of FIG. 1.

FIG. 4 shows a different perspective view of the watch strap 2 without the watch module 28 attached. It can be seen that the watch supporting portion 6 comprises a first larger aperture 42 and a second smaller aperture 44. The watch supporting portion 6 also comprises a recessed portion 46. The watch module 28 as seen in FIG. 3 can be inserted into the apertures 42, 44 in the watch supporting portion 6. In the example shown the watch module 28 is inserted from the inwards facing side which would rest against the user's wrist. The curved flange 38 of the watch module 28 rests in the recessed portion 46 which prevents the watch module 28 from passing through the apertures 42, 44. The user interface 32 is received in the smaller aperture 44 and the display housing 30 is received in the larger aperture 42.

Although not shown, the watch module 28 and the watch supporting portion 6 may comprise corresponding features that lock the watch module 28 in place. This may for example be in the form of recesses and protrusion which are able to lock into each other to hold the watch module 28 in the watch supporting portion 6.

In the example shown the watch module 28 is detachable, which makes it particularly important to ensure the watch strap 2 does not become loose or undone and thus prevents the user from losing the watch module 28. Whilst in the example shown the watch module 28 is detachable it is appreciated that the watch module 28 may be permanently attached to the watch strap 2.

Additionally, in the example shown the watch module 28 it is inserted from underneath the watch supporting portion 6, however it is appreciated that it may be desirable to attach the watch module 28 to the strap in alternative ways. For example it could be attached from the outwards facing side of the strap 2. This may be beneficial in situations where the user takes the watch module 28 away from the strap 2 but desires to keep the strap 2 attached to their wrist.

Figure 5:
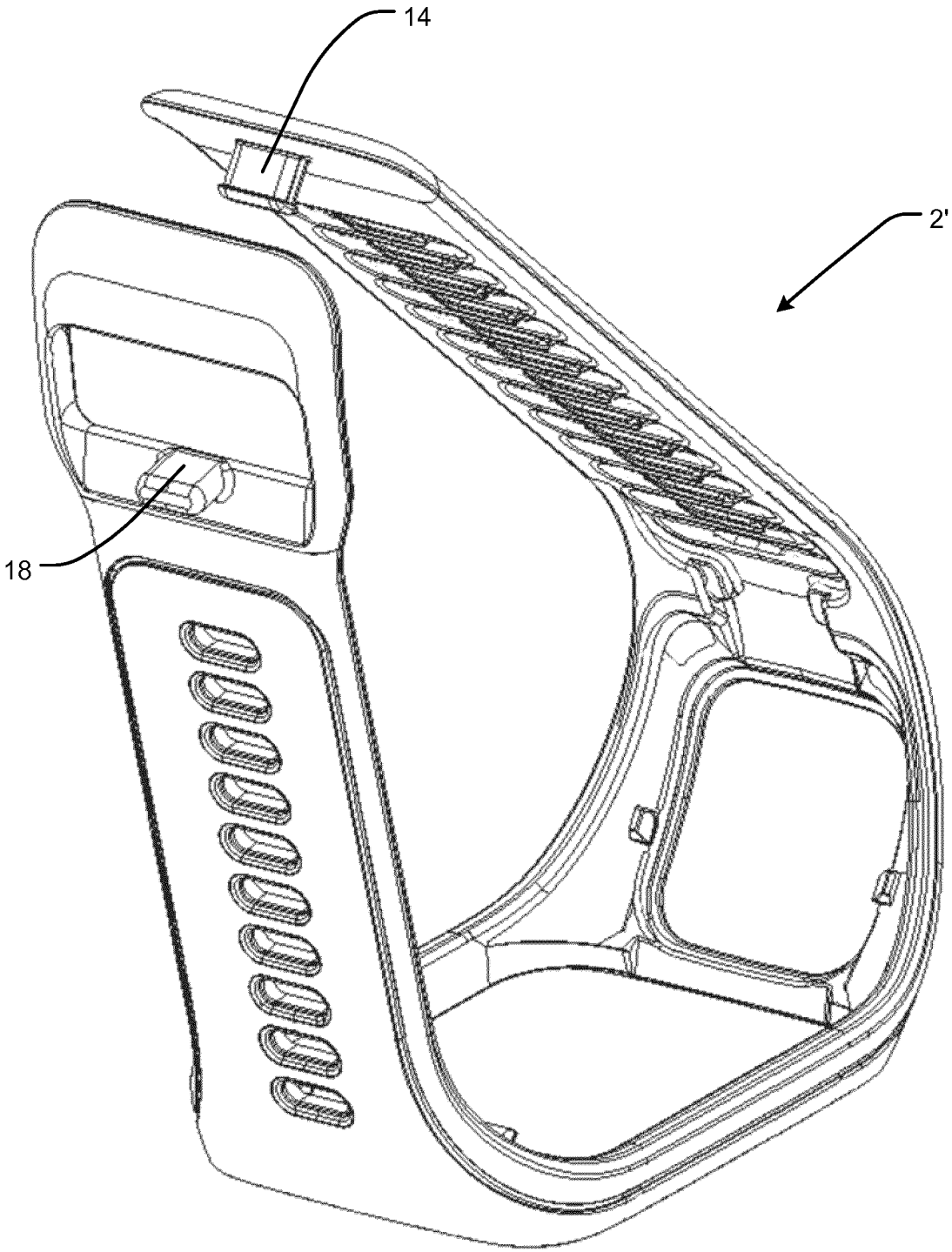
FIG. 5 shows a perspective view of a second watch strap according to a preferred embodiment.

FIG. 5 shows a perspective view of a watch strap 2' that has only one set of holes 22,24 in the first and second fastening portions 4,8. Accordingly, there is only one pin 12,14 on each of the first and second fastening portions 4,8, together with only one peg 18 on the angled portion 20 of the opening 10. It will be appreciated that whilst various aspects and embodiments of the present invention have heretofore been described, the scope of the present invention is not limited to the particular arrangements set out herein and instead extends to encompass all arrangements, and modifications and alterations thereto, which fall within the scope of the appended claims.

For example, whilst the strap 2 has been described for use with a user's wrist, it is appreciated that it may be attached to other suitable limbs or objects. For example the strap could be attached to a user's bike handlebars.

Lastly, it should be noted that whilst the accompanying claims set out particular combinations of features described herein, the scope of the present invention is not limited to the particular combinations hereafter claimed, but instead extends to encompass any combination of features or embodiments herein disclosed irrespective of whether or not that particular combination has been specially enumerated in the accompanying claims at this time.

The invention claimed is:

1. A strap for a watch comprising:

a first fastening portion;

a watch supporting portion; and a second fastening portion, the first and second fastening portions comprising a series of holes spaced along each fastening portion, the first fastening portion comprising an opening through which the second fastening portion can be threaded, at least one pin projecting inwards from the first fastening portion so as to be received in a hole in the second fastening portion, and at least one peg projecting outwards from the first fastening portion so as to engage in a hole in the second fastening portion, the at least one pin and the at least one peg of the first fastening portion being positioned on opposite edges of the opening, and the second fastening portion comprising at least one pin projecting inwards from the second fastening portion so as to be received in a hole in the first fastening portion when the second fastening portion is threaded through the opening and laid on top of the first fastening portion, wherein the at least one pin and the at least one peg of the first fastening portion are integrally moulded in the first fastening portion, so that the first fastening portion is a first single piece of material having the at least one pin and the at least one peg of the first fastening portion projecting fixedly from the first fastening portion with neither of the at least one pin and the at least one peg of the first fastening portion being hinged with respect to the first fastening portion, and wherein the at least one pin of the second fastening portion is integrally moulded in the second fastening portion, so that the second fastening portion is a second single piece of material having the at least one pin on the second fastening portion projecting fixedly from the second fastening portion.

2. The strap of claim 1, wherein the at least one peg projects from an angled portion of the first fastening portion that forms an edge of the opening.

3. The strap of claim 1, wherein the at least one peg is angled relative to an outwards facing surface of the first fastening portion at an acute angle.

4. The strap of claim 3, wherein the at least one peg is angled towards the direction in which the second fastening portion is threaded through the opening.

5. The strap of claim 1, wherein the opening is integrally moulded with the first fastening portion.

6. The strap of claim 1, wherein the at least one pin of the second fastening portion is located proximal to the distal end of the second fastening portion and wherein the at least one pin of the first fastening portion is located proximal to the distal end of the first fastening portion.

7. The strap of claim 6, wherein the at least one pin of the first fastening portion is positioned proximal to the opening.

8. The strap of claim 1, wherein the at least one pin and the at least one peg of the first fastening portion are positioned on opposite sides of the opening.

9. The strap of claim 1, wherein the at least one pin of the first fastening portion and the second fastening portion are normal to the respective first or second fastening portion.

10. The strap of claim 1, wherein the at least one pin of the second fastening portion and/or the at least one pin of the first fastening portion has a flanged portion at its end.

11. The strap of claim 1, wherein a pair of pins is provided on both the first and second fastening portions and a pair of pegs is provided on the first fastening portion and a series of two rows of holes is provided on both the first and second fastening portions.

12. The strap of claim 1, wherein the first and second fastening portions are more flexible than the watch supporting portion.

13. The strap of claim 1, wherein an integral watch supporting portion is provided between the first and second fastening portions.

14. The strap of claim 1, wherein the watch supporting portion comprises at least one aperture for receiving a watch module.

15. The strap of claim 14, wherein the aperture comprises a snap-fit mechanism to secure a watch module when it is positioned within the aperture.

16. A watch comprising a watch module removably mounted to a strap according to claim 1.

* * * * *